US005874388A

United States Patent [19]

Hsu

[11] Patent Number: 5,874,388

[45] Date of Patent: Feb. 23, 1999

[54] LUBRICANT COMPOSITION FOR DISC BRAKE CALIPER PIN AND A DISC BRAKE ASEMBLY CONTAINING THE LUBRICANT

[75] Inventor: Chris Jinfuh Hsu, Ann Harbor, Mich.

[73] Assignee: Dow Corning Corporation, Midland, Mich.

[21] Appl. No.: 832,588

[22] Filed: Apr. 2, 1997

[51] Int. Cl.[6] ..... C10M 105/76

[52] U.S. Cl. ..... 508/183; 508/209

[58] Field of Search ..... 508/183

[56] References Cited

U.S. PATENT DOCUMENTS

| | | | |
|---|---|---|---|
| 2,644,802 | 7/1953 | Lontz et al. | 508/183 |
| 3,671,429 | 6/1972 | Wright | 508/183 |
| 4,251,431 | 2/1981 | Carswell et al. | 508/183 |
| 4,405,469 | 9/1983 | Hafner et al. | 508/183 |
| 5,160,646 | 11/1992 | Scheld | 508/183 |

FOREIGN PATENT DOCUMENTS 4-246452 9/1992 Japan .

*Primary Examiner*—Jacqueline V. Howard
*Attorney, Agent, or Firm*—Alexander Weitz

[57] ABSTRACT

There is disclosed a composition which is particularly suited for lubricating the contact area between the guide pin and elastomeric bushing of a disc brake caliper assembly, said composition consisting essentially of:

(A) 55 to 90 weight percent of a polydimethylsiloxane having a viscosity of at least 1,000 cS at 25° C.;

(B) 5 to 45 weight percent of a polytetrafluoroethylene powder;

(C) 5 to 45 weight percent of melamine cyanurate;

(D) 0.1 to 5 weight percent of an antioxidant; and (E) 0.1 to 5 weight percent of magnesium oxide.

20 Claims, 1 Drawing Sheet

LUBRICANT COMPOSITION FOR DISC BRAKE CALIPER PIN AND A DISC BRAKE ASEMBLY CONTAINING THE LUBRICANT

FIELD OF THE INVENTION

The present invention relates to an improved lubricant or grease which is used to lubricate the contact area between the guide pin and elastomeric bushing of a disc brake caliper assembly.

BACKGROUND OF THE INVENTION

Sliding caliper disc brake assemblies have been in use in automotive applications for many years. For example, in a passenger vehicle at least one brake pad is supported by a metal caliper guide pin which typically slides within an elastomeric bushing, the latter being supported by a member which is stationary with respect to the body of the vehicle. When actuated, the guide pin urges the brake pad against a disc which is generally mounted on the vehicle's wheel and the resulting frictional forces reduce the speed of the moving vehicle or bring it to a complete stop. In order for the brake assembly to operate efficiently, the guide pin must slide freely within its surrounding bushing and therefore the contact area between guide pin and bushing must remain well lubricated. In this regard, the bushing serves at least three functions: (1) it contains any lubricant employed, (2) it eliminates metal-to-metal contact and the wear and noise associated therewith and (3) it excludes dirt, water and other corrosive elements which detract from smooth operation.

However, even with the best current disc brake designs which employ specially formulated lubricants, there is still a certain hysteresis associated with the sliding motion of the guide pin. This phenomenon is called "stiction," which is defined for the purposes of the present invention as the force required to overcome the static friction between the guide pin and the bushing at any given position within the pin's range of travel. Stiction typically increases with time as the brake assembly sits at rest for prolonged periods and this inactivity further reduces brake performance. Moreover, the brake assembly is often exposed to harsh environments during normal use (e.g., water, road salt, dirt, oil) and such exposure can greatly accelerate deterioration of the lubricant and promote corrosion of the guide pin. This, in turn, can result in increased stiction, reduced brake reliability and, eventually, brake failure. further, the lubricant must be compatible with the elastomeric bushing and should not excessively swell or otherwise adversely affect the bushing.

Various compositions which can be used as a grease or lubricant in the above described application are available commercially, but all of these systems are found lacking in one or more of the aforementioned desired characteristics. Thus, for example, petroleum-based greases tend to swell the elastomeric bushing and cause premature system failure. Greases based on poly alkylene glycol (PAG) or silica-filled silicone generally exhibit high stiction in this application. Greases based on perfluoropolyether (PFPE) are often too expensive for automotive application. There is therefore a need for improved compositions which can be used to lubricate the guide pin/bushing combination of the above described disc brake assemblies.

SUMMARY OF THE INVENTION

It has now been discovered that the above described limitations of currently available lubricating compositions can be significantly reduced by employing a blend of a polydimethylsiloxane oil, a polytetrafluoroethylene powder and melamine cyanurate as the lubricant for the guide pin/bushing combination. When this composition is used to lubricate the pin/bushing combination of a disc brake assembly, a low stiction between the pin and bushing results. This improvement is also observed after heat aging of the pin/bushing combination. Further, when the lubricating composition of the present invention is used, little or no corrosion of the caliper pin results, even upon prolonged exposure to a salt/water environment. Additionally, the composition of the present invention does not result in excessive swell of the elastomeric bushings typically used in the brake assemblies and can result in a "sealed for life" caliper pin/elastomeric bushing combination.

The present invention, therefore, relates to a composition consisting essentially of:

(A) 55 to 90 weight percent of a polydimethylsiloxane having a kinematic viscosity of at least 1,000 cS at 25° C.;

(B) 5 to 45 weight percent of a polytetrafluoroethylene powder;

(C) 5 to 45 weight percent of melamine cyanurate;

(D) optionally, up to 5 weight percent of an antioxidant; and (E) optionally, up to 5 weight percent of magnesium oxide, the total of components (A) through (E) being 100 weight percent.

The invention further relates to a method for lubricating the interface between the guide pin and the elastomeric bushing of a disc brake caliper using the above described composition.

The invention also relates to a disc brake assembly comprising a stationary supporting member having an elastomeric bushing disposed therein, said bushing having a pin slidably disposed therein so as to form a contact area between said pin and said bushing and a lubricant being applied to at least a portion of said contact area, the improvement wherein said lubricant is the above described composition.

DETAILED DESCRIPTION OF THE INVENTION

Figure 1:
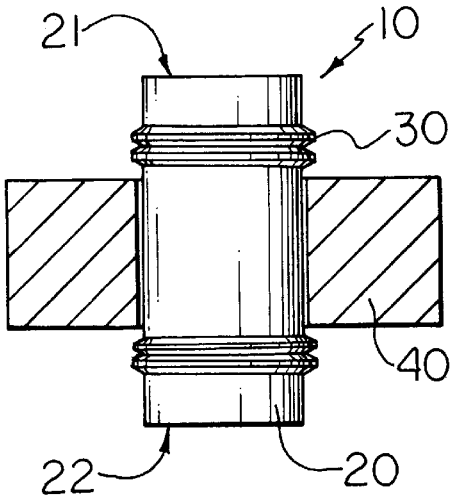
FIG. 1 is a plan view of a commercially available caliper pin/elastomeric bushing combination for a disc brake assembly, the combination being supported in an aluminum block which is shown in cross-section. The pin/bushing combination is shown in cross-section in corresponding FIG. 1A.

The composition of the present invention is prepared by thoroughly mixing components (A) through (C) and, optionally, components (D) and (E), to form a grease which is particularly suitable for lubricating the pin to bushing contact area of an automotive disc brake.

Polydimethylsiloxane (A) according to the present invention is a fluid having a kinematic viscosity of at least 1,000 cS ($10^{-3}$ m/s) at 25° C., preferably 10,000 to 1,000,000 cS at 25° C. and most preferably about 30,000 cS. This polydimethylsiloxane may be a homopolymer or it may contain up to about 15 mole percent, more preferably no more than about 10 mole percent, of diorganosiloxane units which are copolymerized with dimethylsiloxane units. The organic groups of the diorganosiloxane units may be selected from hydrocarbon radicals or halogenated hydrocarbon radicals having 1 to 10 carbon atoms. Examples of suitable component (A) include polydimethylsiloxane homopolymers, copolymers of dimethylsiloxane units and methylphenylsiloxane units, copolymers of dimethylsiloxane units and methyl-3,3,3-trifluoropropylsiloxane units, copolymers of dimethylsiloxane units and methylbetaphenylethylsiloxane units, copolymers of dimethylsiloxane units and methyl-beta-phenylethyl-siloxane units and copolymery of dimethylsiloxane units and methylcyclohexylsiloxane units, inter alia. It is preferred that these diorganosiloxane units are selected from the group consisting of methyl-3,3,3-trifluoropropylsiloxane units and methylphenylsiloxane units.

The terminal groups on polydimethylsiloxane (A) are not critical for the purposes of the present invention as long as they are inert with respect to the other ingredients and to the materials used to fabricate the guide pin and bushing. These may be illustrated by such groups as trimethylsiloxy, dimethylphenylsiloxy and diethylphenylsiloxy. Most preferably, component (A) is a polydimethylsiloxane homopolymer having trimethylsiloxy terminal units.

Component (A) is well known in the art and many such polymers and copolymers are available commercially.

For the purposes of the present invention, the polytetrafluoroethylene (PTFE) powder (B) is a particulate homopolymer of tetrafluoroethylene. This powder preferably has an average particle size (i.e., major particle dimension) of about 1 to about 20 microns. When the particle size is greater than about 20 microns, the grease prepared according to the present invention is quite sticky and is difficult to pump and apply to the pin/bushing interface. From a practical perspective, PTFE powder having an average particle size below about 1 micron is difficult to prepare. Preferably, component (B) has an average particle size of about 2 to 5 microns and a specific surface area greater than about 5 $m^2/g$ since these conditions result in particularly low stiction forces between the guide pin and bushing elements of a disc brake assembly upon application of the lubricating composition.

PTFE powders are commercially available from, e.g., DuPont Polymers (Wilmington, Del.) under the tradename Teflon™ or from Customs Compounding, Inc. (Aston, Pa.) under the tradename polylube™.

Melamine cyanurate (C) is a key ingredient of the present invention and contributes to the reduced stiction and improved thermal stability characteristic of the instant lubricating compositions. This component is also known in the art as cyanuric acid compound with melamine and has the following structural formula

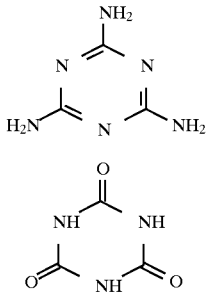

Melamine cyanurate (MC) is a well known material of commerce and further description thereof is considered unnecessary.

In order to prepare the lubricating composition of the invention, about 55 to 90 weight percent of polydimethylsiloxane (A), 5 to 45 weight percent of polytetrafluoroethylene powder (B) and 5 to 45 weight percent of melamine cyanurate (C) are blended to provide a grease wherein the total of these component is 100 weight percent. Preferably, the percentages are 60 to 80% (A), 10 to 30% (B) and 10 to 30% (C), the total again being 100%.

In addition to the above ingredients, preferred compositions of the present invention also contain up to 5 weight percent, preferably 0.1 to 1% and most preferably about 0.5%, of an antioxidant (D) and up to 5 weight percent, preferably 0.1 to 1% and most preferably about 0.5%, of magnesium oxide (E), the total of components (A) through (E) again being 100 weight percent.

The antioxidant provides added stability to the composition when it is exposed to the high temperatures encountered under normal as well as extreme braking conditions. This component is preferably a hindered phenol such as Irganox™ 1035, a sulfur containing hindered bisphenol; Irganox™ L 135, a liquid hindered phenol; Irganox™ L 118, a liquid sulfur containing hindered phenol; and Irganox™ L 64, a liquid blend of phenolic/aminic antioxidants. Also preferred is Irganox™ L 57, a liquid alkylated diphenylamine, all of the above antioxidants being marketed by Ciba-Geigy (Additives Division, Hawthorne, N.Y.). Additionally, N-phenyl-1-naphthylamine is a preferred antioxidant.

Magnesium oxide (MgO) imparts an anticorrosion quality to the composition with respect to ferrous metals such as the steel typically used to form the caliper pin. Use of both components (D) and (E) is particularly preferred and results in the least pin corrosion.

Although the inclusion of components such as (D) and (E) are contemplated herein, certain low molecular weight organic compounds (which tend to swell the elastomeric bushing of the disc brake assembly are specifically excluded from the instant compositions. Examples of such compounds are low molecular hydrocarbon compounds such as alkanes, alkenes, alkynes and diacetylene compounds. In general, no swell of the rubber bushing (typically EPDM) is desired, but up to about 1% swell can be tolerated for the purposes of the present invention.

There is no particular limitation on the method used to prepare the compositions of the present invention as long as components (B) and (C), and optionally components (D) and (E), are thoroughly dispersed in polydimethylsiloxane (A). Thus, for example, the components are typically mixed using a mechanical blade mixer, three-roll mill or homogenizer and order of mixing is not critical provided the resulting dispersion is uniform.

EXAMPLES

The following examples are presented to further illustrate the composition and method of this invention, but are not to be construed as limiting the invention, which is delineated in the appended claims. All parts and percentages in the examples are on a weight basis and all measurements were obtained at about 25° C. unless indicated to the contrary.

The following materials were employed in the examples: Polylube™ J14 is described as a PTFE powder having an average particle size of 2.0 microns and a bulk density of 254 grams/liter. It is marketed by Custom Compounding (Aston, Pa.). Melapur™ MC25 is described as a melamine cyanurate (MC) having a bulk density of 162 g/l which is marketed by DSM Chemie Linz (Linz, Austria). PDMS-1 is a trimethylsiloxy-terminated polydimethylsiloxane having a viscosity of 100,000 cS. PDMS-2 is a trimethylsiloxy-terminated polydimethylsiloxane having a viscosity of 30,000 cS. Irganox™ 1035 is described as a sulfur containing hindered bis-phenol antioxidant which is marketed by Ciba-Geigy (Additives Division, Hawthorne, N.Y.). MgO is a magnesium oxide powder obtained from Aldrich Chemical Co. (Milwaukee, Wis.) PNA is N-phenyl-1-naphthylamine obtained from Uniroyal Chemical Co. (Middlebury, Conn.).

Example 1

A caliper pin/bushing lubricant according to the present invention was prepared by thoroughly mixing Polylube™ J14, MC, PDMS-1, and PNA in a ratio of 10:10:79.5:0.5, respectively. Mixing was accomplished by first stirring the ingredients by hand and then passing the resulting blend through a three-roll mill (three passes).

Example 2

A caliper pin/bushing lubricant was prepared as described in Example 1 by thoroughly mixing Polylube™ J14, MC, PDMS-1, Irganox™ 1035 and MgO in a ratio of 10:10:79:0.5:0.5, respectively.

Example 3

A caliper pin/bushing lubricant was prepared as described in Example 1 by thoroughly mixing Polylube™ J14, MC and PDMS-2 in a ratio of 10:25:65, respectively Example 4

A caliper pin/bushing lubricant was prepared as described in Example 1 by thoroughly mixing Polylube™ J14, MC, PDMS-2, and Irganox™ 1035 in a ratio of 10:25:64.5:0.5, respectively .

Example 5

A caliper pin/bushing lubricant was prepared as described in Example 1 by thoroughly mixing Polylube™ J14, MC, PDMS-2, and MgO in a ratio of 10:25:64.5:0.5, respectively .

Example 6

A caliper pin/bushing lubricant was prepared as described in Example 1 by thoroughly mixing Polylube™ J14, MC, PDMS-2, Irganox™ 1035 and MgO in a ratio of 10:25:64:0.5:0.5, respectively.

(Comparative) Example 7

Permatex™ Ultra Disc Brake Caliper Lube is a synthetic lubricant marketed by Loctite Corp. (Newington, Conn.).

(Comparative) Example 8

G661™ is a lubricant marketed by GE (Waterford, N.Y.).

(Comparative) Example 9

RCL 612™ is a lubricant marketed by Roy Dean Products Co. (Plymouth, Mich.).

(Comparative) Example 10

Niglube™ RM is described as a grease based on poly alkylene glycol ether and marketed by Nippon Grease Company (Osaka, Japan).

(Comparative) Example 11

Nye 990A™ is a lubricant which contains PTFE and polydimethylsiloxane and is marketed by William F. Nye, Inc. (New Bedford, Mass.).

Figure 1A:
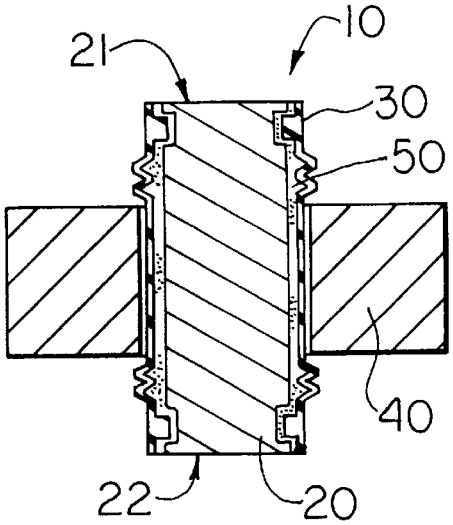

The lubricant prepared in Example 1 was tested in the caliper pin/bushing combination (10) which is illustrated in FIG. 1. In this figure, a (round) cylindrical steel pin (20), having a top surface (21) and a bottom surface (22) and hole therethein is centrally positioned within elastomeric (EPDM rubber) bushing (30). FIG. 1A is a cross-sectional view of the pin/bushing combination taken along the axis of pin (20). For test purposes, the pin/bushing combination was supported in machined aluminum block (40). The actual pin/bushing combination used was manufactured by Bendix Corp. (South Bend, Ind.), as part number H5093. The composition of Example 1 was applied to space (50) between pin (20) and bushing (30) and the lubricated pin/bushing combination was stored for 24 hours at room temperature. The lubricated pin/bushing combination, along with its supporting block, were then placed in an Instron testing machine, wherein the aluminum block was fixed with respect to the frame of the test machine. Starting from a static condition, the pin was axially displaced with respect to the bushing by a traveling cross-head of the machine which pressed upon surface (21) of the pin. The cross-head speed was programmed at 0.1 in/min. (0.25 cm/min.) and the associated force required to displace the pin relative to the bushing was recorded. The maximum static force recorded is the stiction value according to this procedure.

The stiction value for the composition of Example 1 was 3.6 lb. (16.0N). For comparison, this procedure resulted in a stiction value of 4.4 lb. (19.6N) for the grease RLC™ 612 (Comparative Example 9).

The above procedure was repeated wherein the lubricated pin/bushing combinations were placed in an oven at 150° C. for one week. These were then allowed to sit for 24 hours at room temperature. The stiction values were 12.7 lb. (56.5N) and 16.0 lb. (71.2N) for the composition of Example 1 and the RLC™ 612 (Comparative Example 9), respectively.

Figure 2:
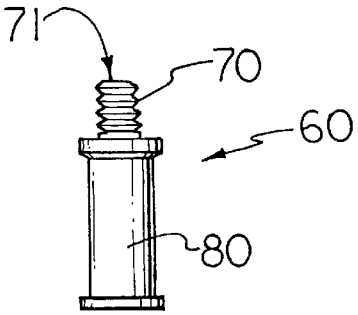
FIG. 2 is a plan view of another, similar, commercially available pin/bushing combination which is shown in cross-section in FIG. 2A.
Figure 2A:
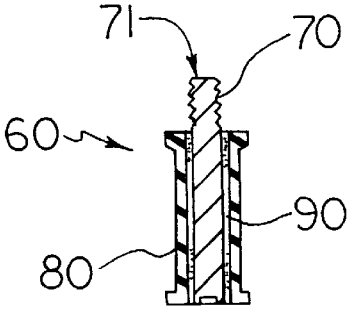

The above tests were repeated using the compositions of Examples 3, 4, 5, 6, 7, 8, 10 and 11. In this case, a different pin/bushing combination (60), shown in FIG. 2, was used for the stiction tests. In FIG. 2, a (round) cylindrical steel pin (70), having a top surface (71), is centrally positioned within elastomeric bushing (80). FIG. 2A is a cross-sectional view of the pin/bushing combination taken along the axis of pin (70). In this case, the lubricating composition was applied to space (90) between pin (70) and bushing (80). Again, for test purposes, the pin/bushing combination was supported in an aluminum block, the latter not being explicitly shown in FIGS. 2 and 2A. The pin/bushing combination used in this series of tests was manufactured by General Motors (Detroit, Mich.) for use on their Buick Park Avenue model vehicles as part numbers 18020038 and 18017632. Results of stiction tests, before and after the above described heat aging, are shown in Table 1.

In addition, the corrosion resistance imparted by these compositions was evaluated after 120 hours at 35° C. according to a standard salt spray procedure (ASTM B117) using steel Q-panels wherein each composition was applied to a panel at a coating thickness of approximately 0.16 mm. Results of these tests are also reported in Table 1 as the percent of panel surface which exhibited corrosion.

TABLE 1

| Example | 3 | 4 | 5 | 6 | 7 | 8 | 10 | 11 |
|---|---|---|---|---|---|---|---|---|
| R.T. Stiction | | | | | | | | |
| (lb.) | 2.9 | 2.3 | 2.5 | 2.4 | 6.8 | 3.0 | 3.2 | 3.0 |
| (N) | 12.9 | 10.2 | 11.1 | 10.7 | 30.3 | 13.4 | 14.2 | 13.4 |
| Heat Aged Stiction | | | | | | | | |
| (lb.) | 2.5 | 2.7 | 2.6 | 2.1 | 23.5 | 5.2 | 7.2 | 2.4 |
| (N) | 11.1 | 12.0 | 11.6 | 9.3 | 105 | 23.1 | 32.0 | 10.7 |
| Corrosion (%) | 0 | 3 | 1 | 0 | 100 | 80 | 0 | 80 |

The above room temperature (R.T.) stiction tests were repeated using the pin/bushing combination of FIG. 2. The stiction value for the composition of Example 2 was 3.5 lb. (15.6N). For comparison purposes, the stiction value using the grease RLCT™ 612 (Comparison Example 9) was 8.6 lb. (38.3N).

From the above tests it is seen that the lubricant compositions of the present invention result in low stiction, both before and after aging at elevated temperature. At the same time, these compositions also impart a high degree of corrosion resistance to a ferrous substrate.

That which is claimed is:

1. A composition consisting essentially of:

(A) 55 to 90 weight percent of a polydimethylsiloxane having a viscosity of at least 1,000 cS at 25° C.;

(B) 5 to 45 weight percent of a polytetrafluoroethylene powder; and (C) 5 to 45 weight percent of melamine cyanurate, the total of components (A) through (C) being 100 weight percent.

2. The composition according to claim 1, wherein component (A) is a polydimethylsiloxane homopolymer and component (B) is a polytetrafluoroethylene homopolymer powder.

3. The composition according to claim 2, wherein said polytetrafluoroethylene powder has an average particle size of 1 to 20 microns.

4. The composition according to claim 3, wherein said polydimethylsiloxane has a viscosity of 10,000 to 1,000,000 cS at 25° C.

5. The composition according to claim 4, wherein the levels of the components are:

(A) 60 to 80 weight percent, (B) 10 to 30 weight percent and (C) 10 to 30 weight percent, the total of components (A) through (C) being 100 weight percent.

6. A composition consisting essentially of:

(A) 55 to 90 weight percent of a polydimethylsiloxane having a viscosity of at least 1,000 cS at 25° C.;

(B) 5 to 45 weight percent of a polytetrafluoroethylene powder;

(C) 5 to 45 weight percent of melamine cyanurate;

(D) 0.1 to 5 weight percent of an antioxidant; and (E) 0.1 to 5 weight percent of magnesium oxide, the total of components (A) through (E) being 100 weight percent.

7. The composition according to claim 6, wherein component (A) is a polydimethylsiloxane homopolymer and component (B) is a polytetrafluoroethylene homopolymer powder.

8. The composition according to claim 7, wherein said polytetrafluoroethylene powder has an average particle size of 1 to 20 microns.

9. The composition according to claim 8, wherein said polydimethylsiloxane has a viscosity of 10,000 to 1,000,000 cS at 25° C.

10. The composition according to claim 9, wherein said antioxidant is a hindered phenol.

11. The composition according to claim 9, wherein the levels of the components are:

(A) 60 to 80 weight percent, (B) 10 to 30 weight percent, (C) 10 to 30 weight percent, (D) 0.1 to 1 weight percent and (E) 0.1 to 1 weight percent, the total of components (A) through (E) being 100 weight percent.

12. In a disc brake assembly comprising a caliper pin slidably disposed in an elastomeric bushing and having a lubricant composition disposed between said pin and said bushing, the improvement wherein said lubricant is the composition according to claim 1.

13. In a disc brake assembly comprising a caliper pin slidably disposed in an elastomeric bushing and having a lubricant composition disposed between said pin and said bushing, the improvement wherein said lubricant is the composition according to claim 2.

14. In a disc brake assembly comprising a caliper pin slidably disposed in an elastomeric bushing and having a lubricant composition disposed between said pin and said bushing, the improvement wherein said lubricant is the composition according to claim 4.

15. In a disc brake assembly comprising a caliper pin slidably disposed in an elastomeric bushing and having a lubricant composition disposed between said pin and said bushing, the improvement wherein said lubricant is the composition according to claim 5.

16. In a disc brake assembly comprising a caliper pin slidably disposed in an elastomeric bushing and having a lubricant composition disposed between said pin and said bushing, the improvement wherein said lubricant is the composition according to claim 6.

17. In a disc brake assembly comprising a caliper pin slidably disposed in an elastomeric bushing and having a lubricant composition disposed between said pin and said bushing, the improvement wherein said lubricant is the composition according to claim 7.

18. In a disc brake assembly comprising a caliper pin slidably disposed in an elastomeric bushing and having a lubricant composition disposed between said pin and said bushing, the improvement wherein said lubricant is the composition according to claim 9.

19. In a method for lubricating a guide pin, elastomeric bushing combination of a disc brake caliper assembly, wherein said pin is slidably disposed within said bushing, said method comprising applying a lubricant between said pin and said bushing, the improvement wherein said lubricant is the composition according to claim 1.

20. In a method for lubricating a guide pin, elastomeric bushing combination of a disc brake caliper assembly, wherein said pin is slidably disposed within said bushing, said method comprising applying a lubricant between said pin and said bushing, the improvement wherein said lubricant is the composition according to claim 6.

* * * * *